US006370901B1

(12) United States Patent
Tso

(10) Patent No.: US 6,370,901 B1
(45) Date of Patent: Apr. 16, 2002

(54) COMPOUND EVAPORATION SYSTEM AND DEVICE THEREOF

(76) Inventor: Ming-Li Tso, No. 69-3, Jing-Mei Street, Taipei (TW)

( * ) Notice: Subject to any disclaimer, the term of this patent is extended or adjusted under 35 U.S.C. 154(b) by 0 days.

(21) Appl. No.: 09/625,978

(22) Filed: Jul. 26, 2000

(51) Int. Cl.[7] ..... F25B 41/00; F25B 39/02; F25B 47/00

(52) U.S. Cl. ..... 62/277; 62/513; 62/526

(58) Field of Search ..... 62/117, 513, 277, 62/526

(56) References Cited

U.S. PATENT DOCUMENTS 2,079,687 A * 5/1937 Fourness ..... 62/513
2,521,040 A * 9/1950 Casetta ..... 62/513
2,770,104 A * 11/1956 Sweynor ..... 62/277
2,998,712 A * 9/1961 Watkins ..... 62/513
3,145,545 A * 8/1964 Jaeger ..... 62/513
3,381,487 A * 5/1968 Harnish ..... 62/513
4,171,622 A * 10/1979 Yamaguchi et al. ..... 62/160
5,245,843 A * 9/1993 Shimoya et al. ..... 62/515
5,860,290 A * 1/1999 Gregory ..... 62/256

* cited by examiner

*Primary Examiner*—William C. Doerrler
(74) *Attorney, Agent, or Firm*—Troxell Law Office PLLC

(57) ABSTRACT

A compound evaporation device comprises a compressor, a heat discharge divider, a main liquid line, a re-condensed tube, a vapor divider, and a primary vapor tube. The compressor is for compressing a gaseous refrigerant therein. The heat discharge divider communicates the compressor and has heat discharge branch tubes thereon surrounded by heat dissipating fins. The main liquid line communicates the heat discharge branch tubes. The re-condensed tube has a series of turns in alternate directions and communicates with the main liquid line. The expansion valve connects with the re-condensed tube. The vapor divider connects with the expansion valve and has vapor branch tubes surrounded by heat guide fins, and the heat guide fins and/or the vapor branch tube at a bottom thereof contact with the re-condensed tube. The primary vapor tube communicates the vapor branch tubes and the compressor to constitute a complete circuit line.

3 Claims, 2 Drawing Sheets

COMPOUND EVAPORATION SYSTEM AND DEVICE THEREOF

BACKGROUND OF THE INVENTION

1. Field of the Invention

The present invention relates to a compound evaporation system and a device thereof for promoting the efficiency of a refrigeration system.

2. Description of Related Art

It is known that an evaporator is one of parts in a refrigeration system. The evaporator makes the ejected mists of highly pressurized refrigerant absorbing heat such that the liquefied refrigerant can transform into its gaseous state. In other words, the evaporator is a heat supplier to offer heat to the mists of liquefied refrigerant out of a capillary tube or an expansion valve by way of the air, the wind, or the water. This is a theory applied in the refrigeration system for years but, in fact, it is not so perfect in practical application.

It can be understood that the refrigeration system is basically derived from the principle of a cycle with heat transfer and a cold room effect can be obtained by way of refrigerant sucking heat and discharging heat alternately. According to the flow way of refrigerant in the cycle, the refrigerant enters and is pressured by a compressor after leaving the cold room to form in a state of high temperature. Then, the heat in the refrigerant is dissipated to lower down the temperature therein before reaching the cold room. Accordingly, the refrigerant is mostly in a state of liquid at the stage of evaporation and is mostly in a state of gas at the stage of heat suction in the entire process.

The air conditioner is a typical example of refrigeration system. When the refrigerant in the air conditioner is evaporated, the cold air may be fanned into the room to provide cooling effect. When the refrigerant is sucked back to the compressor and then pushed to the heat exchange tube outdoor, the temperature of the refrigerant is decreased by the air or the cooling water outside and condensed to form in a state of liquid before being sent to the evaporation tube indoor. The evaporation tube usually is a coiled copper tube with heat transfer fins thereon. During in the stage of evaporation/heat suction, a problem of condensed water may generate and the condensed water drops downward and gathers beneath the evaporation tube to form an ice flow. The ice flow should be utilized and this is the key spirit of the present invention.

On the other hand, the compressor runs the refrigeration system in a cycle and the power consumption of the compressor is much concerned with the state of the cycling media, i.e., refrigerant. While the refrigerant is sucked back to the compressor in a state of liquid, the compressor has to run with more exertion. Oppositely, while the refrigerant is sucked back to the compressor in a state of gas, the compressor only need to run with less exertion. Less exertion means it is economical for the consumption of electrical power.

For the prior art of refrigeration system, the pipeline is designed to direct the compressor and then to heat exchanging pipeline after the cold room effect. The cold pipe and the hot pipe do not contact with each other such that a great deal of above said condensed water is generated. Furthermore, there is residual liquid refrigerant kept without evaporation. Because the cold condensed water impedes the heat transfer between the refrigerant and the air, it leads the liquid refrigerant moving back to the compressor and results in not only high consumption of power but also low cold room effect.

SUMMARY OF THE INVENTION

The object of the present invention to provide a compound evaporation system and a device thereof with which an efficiency of refrigeration system may increase substantially and the power consumption may be lowered advantageously.

The present invention can be more fully understood by reference to the following description and accompanying drawings.

BRIEF DESCRIPTION OF THE DRAWINGS

The present invention can be more fully understood by referring to the following description and accompanying drawing, in which.

DETAILED DESCRIPTION OF THE PREFERRED EMBODIMENTS

Figure 1:
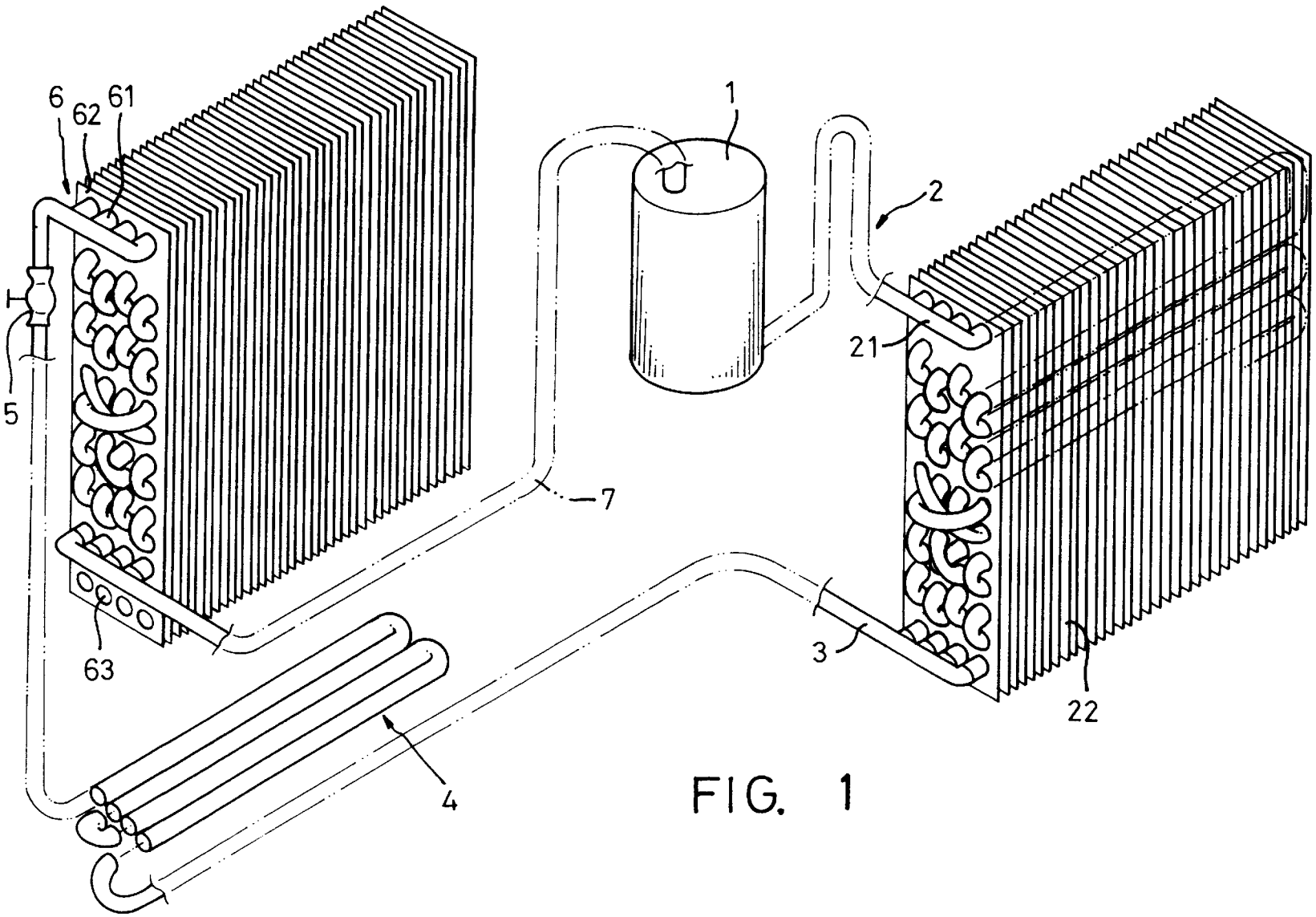
FIG. 1 is an exploded perspective view of a compound evaporation system according to the present invention.
Figure 2:
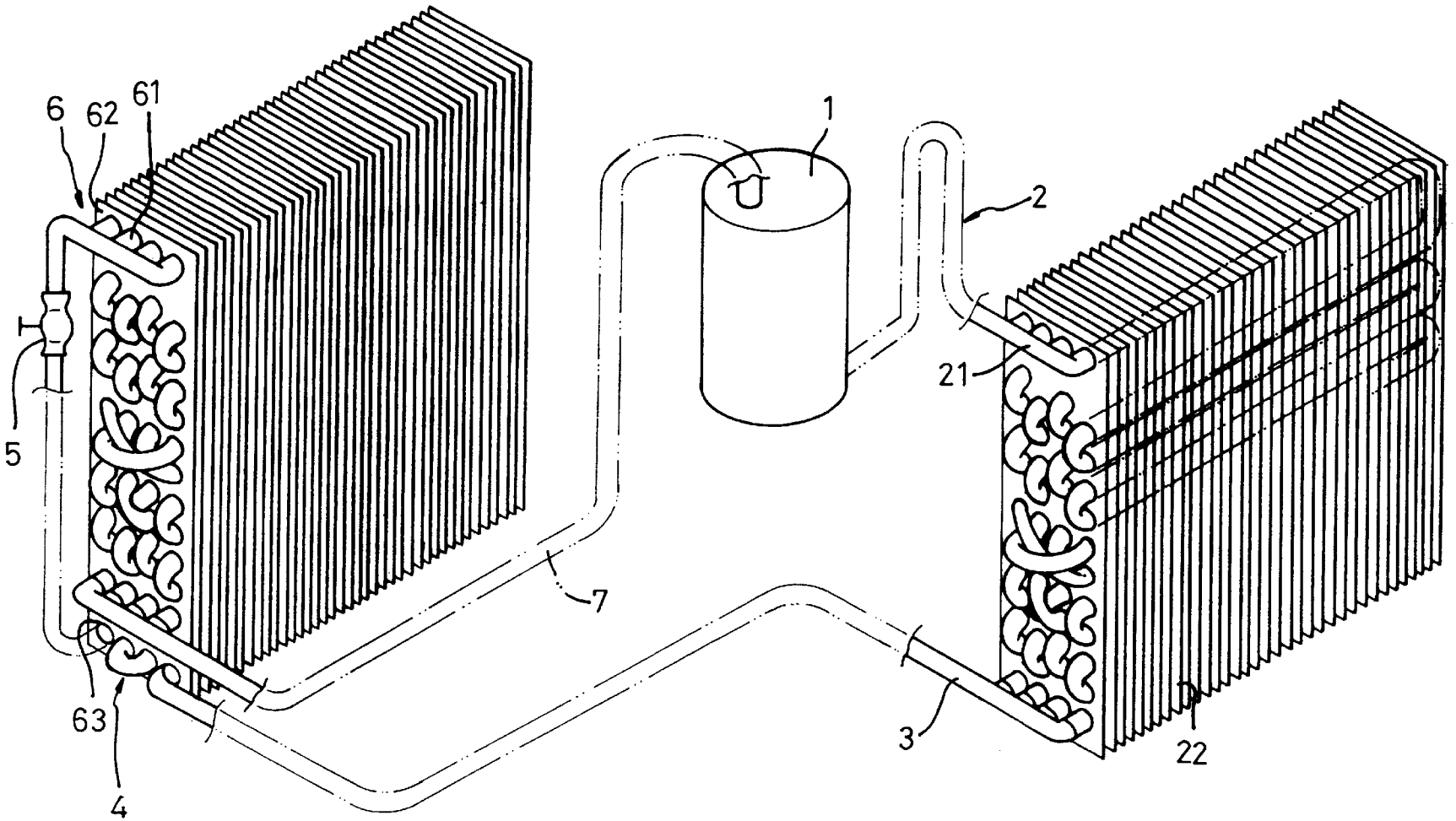
FIG. 2 is a perspective view of the compound evaporation system shown in FIG. 1.

Referring to FIGS. 1 and 2, an evaporation system of the present invention basically comprises a compressor 1, a heat discharge divider 2, a main liquid line 3, a liquid re-condensed tube 4, a liquid expansion valve 5, and a vapor divider 6.

The compressor 1, which is conventional, pressures the refrigerant and pumps the refrigerant outward to flow toward the heat discharge divider 2.

The heat discharge divider 2 provides a plurality of branch discharge tubes 21 to divide the hot gaseous refrigerant coming from the compressor 1. The branch discharge tubes 21 are arranged to extend in parallel for intensifying cooling effect and storage of high pressure. In addition, positions of the branch discharge tubes 21 may be disposed to exchange to each other. That is, inner banks of the branch discharge tubes 21 at the upper half part are arranged to change as the outer banks of branch discharge tubes so as to get an even condensation. In order to enhance the condensing effect, a plurality of heat dissipating fins 22 are provided at the periphery of the branch discharge tubes 21.

The main liquid line 3 is a single tube connecting an outlet of the branch discharge tubes 21 to gather the condensed refrigerant passing through the branch discharge tubes 21. The refrigerant moving in the main liquid line 3 still contains much heat therein.

The liquid re-condensed tube 4 is a tube connecting with the main liquid line 3 and provided with a series of bends in alternate directions so as to transmit the liquid refrigerant to the expansion valve 5. The liquid refrigerant can be re-condensed in the liquid re-condensed tube 4.

A primary purpose of the expansion valve 5 or capillary tube is that the liquid refrigerant passing through can be squeezed by high pressure and becomes in a state of atomization. The expansion valve 5 is a conventional device and no further detail will be described.

The vapor divider 6 as the heat discharge divider 2 does has a plurality of vapor branch tubes 61 to divide the atomized refrigerant coming from the expansion valve 6 and the vapor branch tubes 61 are arranged in parallel and lined up downward with connecting bends. The position of each inner row of the vapor branch tubes 61 at the upper half portion thereof may be disposed to exchange to the position of outer row at the lower half portion thereof. Moreover, a plurality of heat guide fins 62 may be provided at the periphery of the vapor branch tubes 61 to intensify the effect of evaporation. The heat guide fins 62 at the bottom thereof contact with the re-condensed tube 4. The re-condensed tube 4 may insert a bank of locating holes 63 to engage with the heat guide fins 62 as shown in FIG. 2. It is noted that FIG. 2 is only an example of mounting the re-condensed tube 4 and not a restriction. Once the re-condensed tube 4 is attached to the heat guide fins 62, it is possible for the heat exchange between hot lines and cold lines to be proceeded. That is, the heat guide fins 62 and/or the vapor branch tubes 61 at lower parts thereof operates to receive the heat transmitted by the re-condensed tube 4 such that vapor branch tubes 61 and heat guide fins 62 can provide the cold room effect in practice.

A primary evaporator 7 is a tube and an end thereof is communicates with the vapor branch tubes 61 such that the vapor branch tubes 61 are gathered as a single tube. The other end of the primary evaporator 7 connects with the compressor 1 such that the refrigerant can be sent back to the compressor 1 to be pressured and pumped out for another cycle.

Referring to FIGS. 1 and 2 again, when the compound evaporation system is in operation, the gaseous refrigerant in the compressor 1 is sent to the discharge divider 2 first. Thus, the gaseous refrigerant can flow through the branch discharge tubes 21 separately such that the refrigerant is discharged the heat therein and is condensed at the same time. Then, the separated refrigerant is gathered at the main liquid line 3 and enters the re-condensed tube 4 to move along in a curvy way and perform heat exchange with the heat guide fins 62 around the re-condensed tube 4. Therefore, the refrigerant can be condensed once more without reducing its original power at high pressure while flowing to the expansion valve 5 from banks of heat discharge tubes. In this way, the refrigerant can lower down the temperature thereof further while passing through the vapor divider 6 to enhance the cold room effect of vapor branch tubes 61. Due to the heat exchange between the vapor branch tubes 61 and the re-condensed tube 4, the temperature at low pressure rises to prevent the returned tubes of low pressure refrigerant from occurring a phenomenon of dripping. Meanwhile, the refrigerant in the primary evaporator 7 can be in a gaseous state completely without being affected by the condensed water such that no liquid refrigerant flowing back to the compressor 1 so as to reduce the work load of the compressor 1.

A conventional air conditioner has been tested and the electricity consumption measured while in running is 220V/7.96 A. When the compound evaporation system is applied in the identified air conditioner, the current measured is reduced to 6.95 A and the phenomenon of condensed water on the returned tubes is eliminated. In addition, the system of the present invention allows the moisture in the room not being drawn by the air conditioner excessively such that a comfortable humidity for us can be maintained properly.

It is appreciated that the compound evaporation system of the present invention makes the low pressure refrigerant in the returned copper tubes be in a state of gas before entering the compressor and less in quantity. Hence the working load of the compressor may be decreased to save the utilized electricity. In addition, the liquid of high pressure may be re-condensed without affecting the original ejecting power thereof to enhance the cold room effect significantly. Moreover, a appropriate humidity can be kept without being too dry.

While the invention has been described with reference to a preferred embodiment thereof, it is to be understood that modifications or variations may be easily made without departing from the spirit of this invention, which is defined by the appended claims.

What is claimed is:

1. A compound evaporation device for supplying cold air to a cold room and comprising:

a) a compressor for circulating a gaseous refrigerant;

b) an outdoor condenser having an inlet connected to an outlet of the compressor whereby gaseous refrigerant circulates through the outdoor condenser and is condensed into a liquid;

c) an evaporator in the cold room having an inlet, and an outlet connected to an inlet of the compressor, the evaporator having a plurality of heat guide fins;

d) a serpentine re-condenser tube located adjacent to the outlet of the evaporator in heat exchange relationship with the plurality of heat guide fins, and connected to an outlet of the outdoor condenser so as to pass liquid refrigerant therethrough; and e) an atomizing device having an inlet connected to the serpentine re-condenser tube to convert liquid refrigerant from the serpentine re-condenser tube into gaseous refrigerant, the atomizing device having an outlet connected to the inlet of the evaporator such that gaseous refrigerant passes through the evaporator, whereby heat from the re-condenser tube maintains the refrigerant in gaseous form upon exit from the evaporator and entrance into the inlet of the compressor to reduce power consumption of the compressor.

2. The compound evaporation device of claim 1 wherein the atomizing device comprises an expansion valve.

3. The compound evaporation device of claim 1 wherein the atomizing device comprises a capillary tube.

* * * * *